United States Patent [19]

Branson et al.

[11] 4,123,036

[45] Oct. 31, 1978

[54] FUEL CONTROL SYSTEM AND CONTROL DEVICE THEREFOR OR THE LIKE

[75] Inventors: Charles D. Branson; Roy C. Demi, both of Greensburg, Pa.

[73] Assignee: Robertshaw Controls Company, Richmond, Va.

[21] Appl. No.: 742,847

[22] Filed: Nov. 18, 1976

Related U.S. Application Data

[60] Division of Ser. No. 570,864, Apr. 23, 1975, Pat. No. 4,007,907, which is a division of Ser. No. 530,605, Dec. 9, 1974, Pat. No. 3,989,064, which is a continuation-in-part of Ser. No. 443,783, Feb. 19, 1974, abandoned, which is a continuation-in-part of Ser. No. 380,389, Jul. 18, 1973, abandoned.

[51] Int. Cl.[2] ..... F16K 25/00; F23N 1/00

[52] U.S. Cl. ..... 251/180; 137/599; 251/304

[58] Field of Search ..... 236/15 A; 251/180, 304; 137/599

[56] References Cited

U.S. PATENT DOCUMENTS

| | | | |
|---|---|---|---|
| 1,881,637 | 10/1932 | Johnson | 236/15 A |
| 2,540,056 | 1/1951 | Robinson | 251/180 X |
| 2,966,044 | 12/1960 | Mitchell | 62/217 |

FOREIGN PATENT DOCUMENTS

| | | | |
|---|---|---|---|
| 560,409 | 10/1932 | Fed. Rep. of Germany | 251/180 |

*Primary Examiner*—William E. Wayner
*Attorney, Agent, or Firm*—Candor, Candor & Tassone

[57] ABSTRACT

A fuel control device having a passage therethrough for interconnecting a fuel source with a main burner and having a poppet valve arrangement that is directly manually operated for opening and closing the passage so as to control the flow of fuel from the source to the main burner, the poppet valve arrangement having a poppet valve member that is moved relative to its valve seat upon the manual manipulation of a selector of the control device. The poppet valve member can work with the pressure of the fuel from the source thereof when the poppet valve member is being moved to its closed position.

4 Claims, 19 Drawing Figures

FUEL CONTROL SYSTEM AND CONTROL DEVICE THEREFOR OR THE LIKE

This application is a Division of its copending parent application, Ser. No. 570,864, filed Apr. 23, 1975, now U.S. Pat. No. 4,007,907, which, in turn, is a Division of its copending parent application, Ser. No. 530,605, filed Dec. 9, 1974, now U.S. Pat. No. 3,989,064, which, in turn, is a Continuation-in-Part of its parent copending application, Ser. No. 443,783, filed Feb. 19, 1974, now abandoned which, in turn, is a Continuation-in-Part of its parent copending application, Ser. No. 380,389, filed July 18, 1973, and now abandoned in favor of its said copending Continuation-in-Part application.

This invention relates to an improved fuel control system for a fuel burning apparatus, such as a cooking apparatus or the like and to an improved control device for such a fuel control system or the like.

It is well known to provide a fuel control system for a fluid fuel burning apparatus, such as a cooking apparatus or the like, wherein a passage defining means is provided between a source of fuel and the main burner with the passage defining means having a pair of control devices disposed therein in series relation with the first control device having means for manually opening the passage defining means when the selector of the first control device is moved from an "off" position thereof toward an "on" position thereof. The first control device also has means for thermostatically controlling the flow of fuel to the passage means downstream from the main "on-off" valve means thereof while the second control device has its valve means moved from a closed position thereof to an open position thereof when the second control device senses the presence of a large heater flame at a pilot burner means that is disposed adjacent the main burner, the heater pilot being controlled by the thermostatically operated valve means of the first control device.

In particular, the selector of the first control device sets the thermostatically operated valve means thereof to thermostatically control the flow of fuel to the heater pilot means so that when the output temperature effect of the main burner falls below the selected temperature of the selector of the first control device, the thermostatic valve means of the first control device opens and allows not only fuel to flow through the passage defining means to the second control device, but also allows fuel to flow to the heater pilot to form a large heater flame that is detected by the second control device so that the second control device will open and pass the main flow of fuel on to the main burner to be ignited by the pilot burner means. When the output temperature effect of the main burner exceeds the set temperature setting of the selector of the first control device, the thermostatically operated valve means of the first control device closes and thus prevents fuel from flowing to the heater pilot means so that the heater flame ceases to exist and causes the valve means of the second control device to close and block the passage leading to the main burner.

In this manner, the main burner means can be caused to be cycled on and off to tend to maintain the output temperature effect thereof at the temperature selected by the selector of the first control device.

Such fuel control systems are fully disclosed in the U.S. Pat. to Wantz et al, No. 3,132,803 and No. 3,167,250.

However, it has been found according to the teachings of this invention, that in view of the fact that the pressures of gaseous fuels being supplied through pipe lines to be subsequently piped to the ultimate consumer is increasing in order to supply a greater number of users and over greater distances from sources thereof, a series of pressure regulators must be utilized not only in the utility lines, but also in the consumer's building in order to step down the pressure of such high pressure fuel to a useable pressure level for the desired fuel burning apparatus.

Should such step-down fuel pressure regulator means fail so that a relatively high pressure fuel is being delivered to a particular fuel control system of the above type, the main "on-off" valve member of the first control device must withstand such adverse pressures in order to prevent such high pressure fuel from leaking therethrough and into the fuel control system to create a hazardous condition.

Accordingly, it is a feature of this invention to provide an improved control device of the above type having an improved "on-off" valve means therefor that is believed will tend to withstand such high adverse fuel pressure situations and thereby not permit the aforementioned hazardous fuel leaking situation.

Another feature of this invention is to provide a fuel control system utilizing such a control device or the like.

In particular, one embodiment of the improved control device of this invention has a poppet valve member providing the main "on-off" valve means thereof with such poppet valve member being directly movable between its open and closed positions by the selector means of the control device being moved between its "off" position and a certain "on" position thereof, such selector means also setting a thermostatically operated valve means of such control device. The poppet valve member of the control device can be assisted in its seating against its valve seat by the pressure of the fuel from the source thereof.

Further, the improved control device of this invention can be utilized without the aforementioned thermostatically operated valve means for top burner control purposes, such control device also having improved flow control means as will be apparent hereinafter.

Accordingly, it is an object of this invention to provide an improved fuel control device having one or more of the novel features set forth above or hereinafter shown or described.

Another object of this invention is to provide a fuel control system utilizing such a control device or the like.

Other objects, uses and advantages of this invention are apparent from a reading of this description which proceeds with reference to the accompanying drawings forming a part thereof and wherein.

Figure 1:
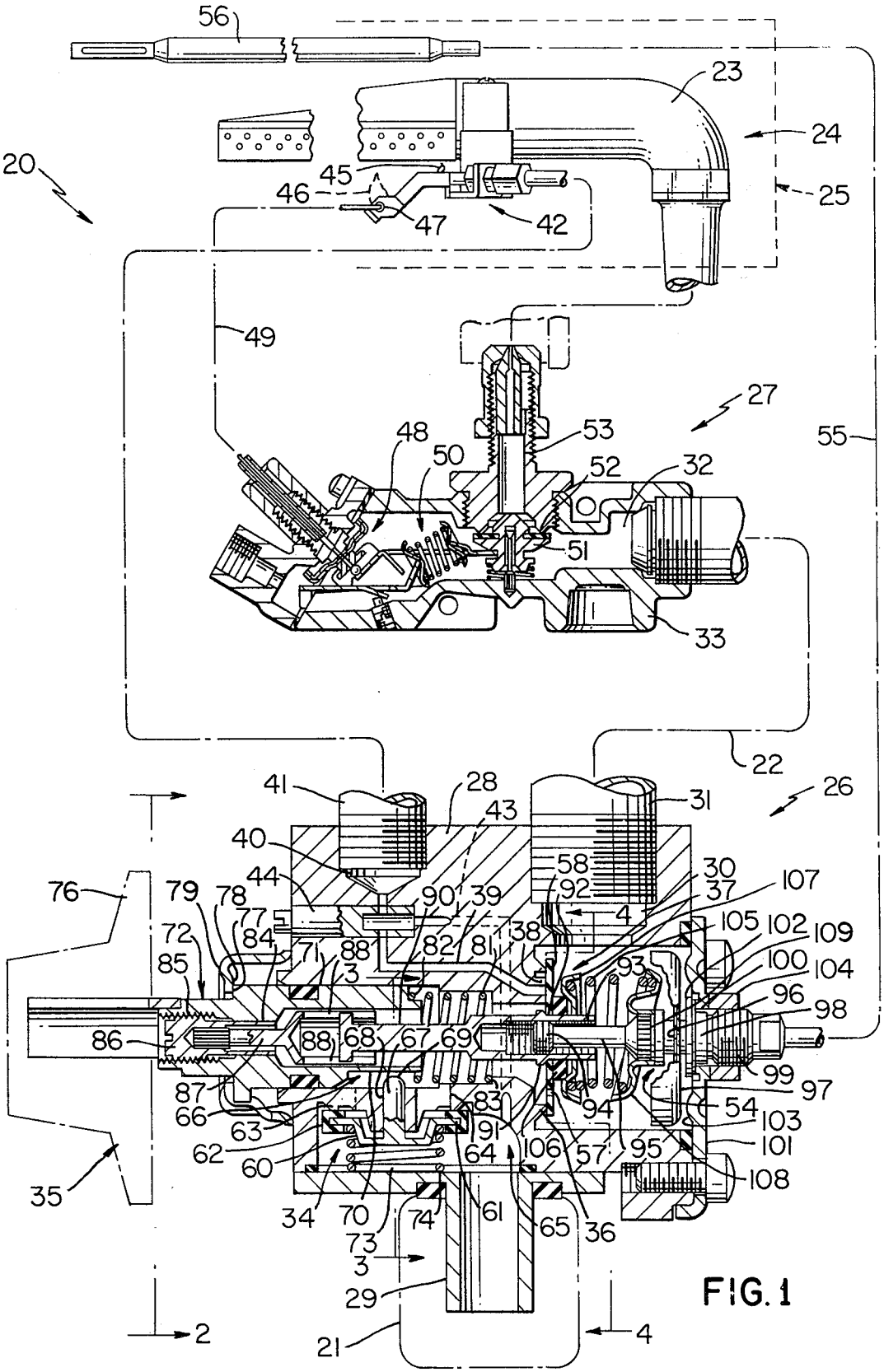
FIG. 1 is a schematic view, partially in cross section, illustrating the improved fuel control device and system of this invention.
Figure 2:
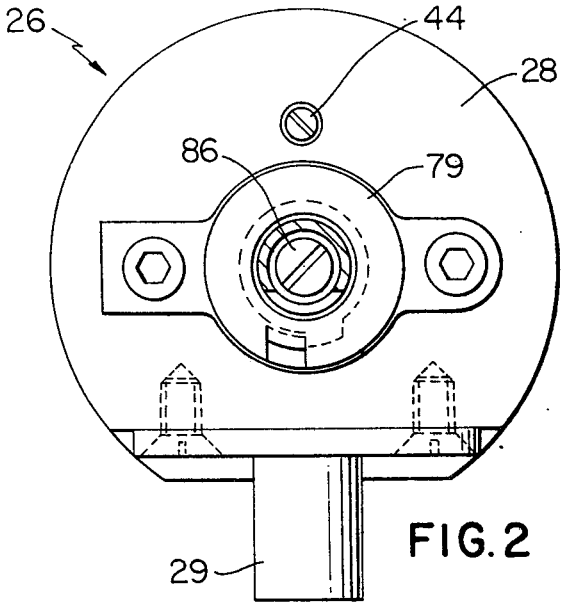
FIG. 2 is a fragmentary, cross-sectional view taken on line 2—2 of FIG. 1.
Figure 3:
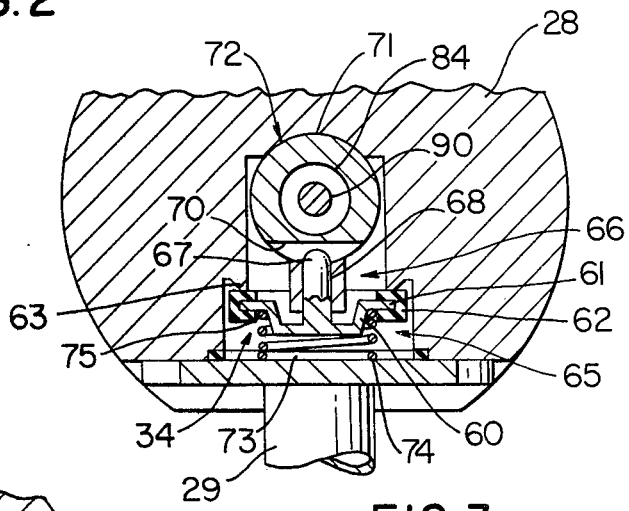
FIG. 3 is a fragmentary, cross-sectional view taken on line 3—3 of FIG. 1.

While the various features of this invention are hereinafter described and illustrated as being particularly adapted to provide a control device for a fuel burning cooking apparatus, it is to be understood that the various features of this invention can be utilized singly or in any combination thereof to provide control devices for other apparatus as desired.

Therefore, this invention is not to be limited to only the embodiments illustrated in the drawings, because the drawings are merely utilized to illustrate some of the wide variety of the uses of this invention.

Referring now to FIG. 1, the improved fuel control system of this invention is generally indicated by the reference numeral 20 and comprises a fuel source manifold 21 being interconnected by passage defining means 22 to a main burner 23 disposed in an oven chamber 24 of a cooking apparatus that is indicated by dash lines and generally indicated by the reference numeral 25, the passage defining means 22 having a pair of control devices disposed therein in series relation and respectively being generally indicated by the reference numerals 26 and 27.

The first fuel control device 26 comprises a housing means 28 having an inlet 29 adapted to be disposed in fluid communication with the fuel supply manifold 21 and an outlet 30 adapted to be interconnected to a conduit means 31 that forms part of the passage defining means 22 and leads to an inlet 32 of a housing means 33 of the second fuel control device 27.

The first fuel control device 26 has a main "on-off" valve means that is generally indicated by the reference numeral 34 in FIG. 1 and is adapted to be directly opened and closed by a selector means 35 of the first fuel control device 26 in a manner hereinafter described. The valve means 34 when moved to an open position will supply fuel from the manifold 21 to a valve seat 36 of the housing 28 that is opened and closed by thermostatically operated valve means that is generally indicated by the reference numeral 37.

The thermostatically operated valve means 37 when opening the valve seat 36, permits the fuel to flow from the opened "on-off" main valve means 34 out through the outlet 30 and thus to the inlet 32 of the second fuel control device 27. The opening of the thermostatic valve means 37 also permits fuel to flow through a second inner valve seat 38 of the fuel control device 26 that leads by a passage means 39 in the housing means 28 to an outlet 40 that is adapted to be coupled by a conduit means 41 to a pilot burner means of the main burner 23, the pilot burner means being generally indicated by the reference numeral 42 and comprising a "dual-rate" pilot burner means.

In particular, the pilot burner means 42 is adapted to be continuously fed a flow of fuel at a small rate from the manifold 21 through a passage means 43 of the control device 26 that bypasses the main "on-off" valve means 34 thereof and leads to the outlet 40 through an adjusting key 44 so that the small amount of fuel that is continuously fed to the pilot means 42 can continuously burn at the pilot burner means 42 to provide a small standby flame 45 even when the selector means 35 is in an "off" position and the cooking apparatus 25 is not being utilized.

However, when the thermostatically operated valve means 37 opens in a manner hereinafter described, additional fuel is adapted to flow to the outlet 40 of the control device 26 through the opened inner valve seat 38 and interconnecting passage 39 so that the additional fuel flowing to the pilot burner means 42 will create a large heater flame 46 at the pilot burner means 42 that is adapted to be detected by a flame sensor or bulb 47 carried by the pilot burner means 42 and being interconnected to an expandible, contractible member 48 in the housing 33 of the control device 27 by a conduit means or capillary tube 49.

The expandible and contractible element 48 of the control device 27 is interconnected by suitable lever and spring means 50 to a poppet valve member 51 that is normally seated against a valve seat 52 of the housing 33 and thereby blocking the inlet 32 of the housing 33 from an outlet 53 thereof so as to prevent fuel from flowing through the passage defining means 22 to the main burner 23 as the outlet 53 is in fluid communication with the main burner 23.

However, the element 48 expands when the detector 47 is sensing the large heater flame 46 at the pilot burner means 42 and the expansion of the power element 48 causes the lever and spring arrangement 50 to move and hold the poppet valve member 51 from its closed position to a fully open position whereby fuel from the inlet 32 in the control device 27 is now permitted to flow to the outlet 53 thereof and, thus, to the main burner 23 to be ignited by the pilot burner means 42.

Thus, as long as the thermostatically operated valve means 37 of the first fuel control device 26 is in an open condition, not only is fuel supplied from the manifold 21 to the second control device 27, but also fuel is supplied to the pilot burner means 42 through the opened valve seat 38 to continuously produce the large heater flame 46 so that the valve member 51 of the fuel control device 27 will remain in an open condition and pass the fuel on to the main burner 23.

However, the thermostatically operated valve means 37 of the fuel control device 26 has an expandible and contractible power element 54 that controls the opening and closing movements thereof, the power element having its interior interconnected by a conduit means 55 to a temperature sensing bulb 56 disposed in the oven chamber 24 and thereby sensing the output temperature effect of the main burner 23.

Thus, when the temperature in the oven chamber 24 exceeds the temperature setting of the selector means 35 of the fuel control device 26, the thermostatic valve means 37 is closed by the expanded power element 54 to not only block the main flow of fuel from the manifold 21 into the conduit 31, but also to block the flow of fuel into the passage 39 of the fuel control device 26 so that the heater flame 46 will no longer be created at the pilot burner means 42. Since the heater flame 46 no longer appears at the pilot burner means 42, the power element 48 of the control device 27 collapses and through the lever and spring arrangement 50 causes the valve member 51 to close against the valve seat 52.

However, due to a thermal lag created by the delay in the time that it takes the power element 48 of the control device 27 to collapse and cause closing of the valve member 51 from the time the heater flame 46 ceases to exist because the thermostatically operated valve means 37 has closed, there is a likelihood that the fuel remaining in the conduit 31 does not have a sufficient pressure to pass out of the burner means 23 and be burned externally thereof so that a flash back situation could exist when the valve means 37 is closed and the control device 27 has its valve member 51 remaining in its open condition due to the thermal lag in the time it takes the power element 48 to collapse.

Accordingly, a bypass passage or orifice 57 is provided through a valve disc 58 of the thermostatically operated valve means 37 to supply sufficient fuel to the outlet 30 to support combustion at the main burner means 23 whenever the valve disc 58 is fully seated against the valve seat 36 and the fuel control device 27 remains open because of the thermal lag in the closing thereof so that the adverse flash back situation will not exist.

Thus, it can be seen that the fuel control device 26 when set in an "on" position thereof not only opens the main on-off valve means 34 thereof, but also sets the desired output temperature effect of the main burner means 23 so that the main burner 23 can be cycled on and off in the manner previously described to tend to maintain the output temperature effect in the oven chamber 24 at the output temperature setting of the selector 35 of the control device 26.

Since the details and theory of operation of the control device 27 and "dual rate" pilot burner 42 are fully set forth in the U.S. Patent to Branson et al., No. 3,367,572 and the U.S. Patent to Riehl, No. 3,405,999, no detailed explanation of the parts and operation of the fuel control device 27 and "dual rate" pilot burner means 42 is deemed necessary as any desired information thereon can be obtained from a reading of the aforementioned patents to Branson et al and Riehl.

However, the details and operation of the fuel control device 26 of this invention will now be described.

The main "on-off" valve means 34 of the control device 26 comprises a poppet valve member 60 that is substantially cup-shaped and has an outer peripheral flange 61 at the open end thereof covered by an annular resilient member 62 adapted to fully seat on an annular valve seat 63 formed in the housing means 28 and surrounding a plurality of openings 64 that lead from a chamber 65 formed in the housing means 28 to a stepped cylindrical chamber 66 formed in the housing means 28, the chamber 65 being interconnected to the inlet 29 while the chamber 66 leads to the annular valve seat 36.

The poppet valve member 60 has a stem 67 passing through a guide opening 68 in the housing 28 in such a manner that a rounded end 69 of the stem 67 is disposed within the chamber 66 and within the path of movement of a cam surface 70 formed on a cylindrical part 71 of a shaft means that is generally indicated by the reference numeral 72 and forming a part of the selector means 35 of the fuel control device 26.

A compression spring 73 is disposed in the chamber 65 and has one end 74 bearing against the housing means 28 and the other end 75 thereof bearing against the poppet valve member 60 to tend to hold the poppet valve member 60 in its closed position against the valve seat 63.

It can also be seen that the fuel pressure being fed from the source 21 into the chamber 65 of the housing means 28 also acts against the valve member 60 in a manner to hold the valve member 60 in its closed position against the valve seat 63.

Thus, when the selector means 35 is in its "off" position, the fuel pressure from the source 21, as well as the compression spring 73, acts to hold the valve member 60 in its closed position against the valve seat 63 so that even though the usual pressure of the fuel in the manifold 21 should increase through a malfunction in a pressure regulator or the like upstream from the manifold 21, the valve member 60 will not be blown off the valve seat 63 but will be further urged against the valve seat 63 so as to prevent such fuel from entering into the control system 20 and creating an adverse situation as previously described.

The shaft means 72 has the shaft part 71 thereof interconnected to a suitable control knob 76 of the selector means 35 and has a shoulder 77 thereof normally urged toward and against the inside surface 78 of a casing member 79 secured to the housing means 28 in alignment with the cylindrical bore or chamber 66 whereby the shaft part 71 closes the left-hand side of the chamber 66. If desired, suitable sealing means 80 can be provided on the shaft part 71 to fluid seal the left-hand part of the chamber 66 as illustrated in FIG. 1. The shoulder 77 of the shaft part 71 is urged against the surface 78 of the casing 79 by a compression spring 81 disposed within the right-hand part of the chamber 66 and having one end 82 bearing against the shaft part 71 and the other end 83 thereof bearing against the housing means 28.

The shaft part 71 has a stepped bore 84 passing therethrough with the bore 84 having its left-hand part 85 internally threaded to receive a threaded adjusting member 86 that carries a member 87 provided with a pair of slots 88 in the right-hand end thereof and which respectively receive opposed outwardly directed tangs on the left-hand end of a shaft part 90 that has a conical outwardly extending abutment 91 thereon. The shaft part 90 is adapted to have its right-hand end in FIG. 1 extend through an opening 92 in the valve disc 58 of the thermostatically operated valve means 37 with the outwardly directed conical abutment 91 being larger than the opening 92 in the valve disc 58 to carry the valve disc 58 therewith in a manner hereinafter described.

The right-hand end of the shaft part 90 is interrupted by a threaded bore 93 which receives a threaded end 94 of a stem member 95 that is carried on a cup-shaped movable wall 96 of the power element 54 which has another cup-shaped wall 97 fixed to a pin means 98 to be carried thereby.

The pin means 98 has a threaded portion 99 adapted to pass through an opening 100 in an end plate 101 of the housing means 28 while a disc-like part 102 of the pin 98 is adapted to abut against the inside surface 103 of the plate 101 in the manner illustrated in FIG. 1. With the plate 102 of the pin 98 abutting against the end plate 101, a lock nut 104 can be threaded on the threaded part 99 of the pin 98 to hold the power element 54 in the position illustrated in FIG. 1, the pin 98 fluidly interconnecting the capillary tube 55 to the spacing between the two cup-shaped members or walls 96 and 97 that have the outer peripheries of the open ends thereof sealed together in a conventional manner.

While the valve disc 58 is loosely disposed on the shaft part 90, the same is either urged toward or against the valve seat 36 or against the conical abutment 91 of the shaft part 90 by a compression spring 105.

In particular, a flexible washer-like member 106 is telescoped onto the shaft member 90 and is disposed against the right side of the disc 58 in FIG. 1. Thereafter, spring retainer 107 is telescoped onto the shaft part 90 against the washer-like member 106.

A spring retainer 108 is disposed on an enlarged knurled part 109 of the shaft 95 so as to fix the same from rotation thereon, the spring retainer 108 being angled relative to the longitudinal and rotational axis of the shaft means 72 so as to cause the compression spring 105 disposed between the spring retainers 107 and 108 to cause tilting of the valve member 58 during its initial opening movement from the valve seat 36 at the same angle relative thereto each time the valve disc 58 initially opens the valve seat 36 as will be apparent hereinafter as well as each time the valve disc 58 closes the valve seat 36.

Figure 4:
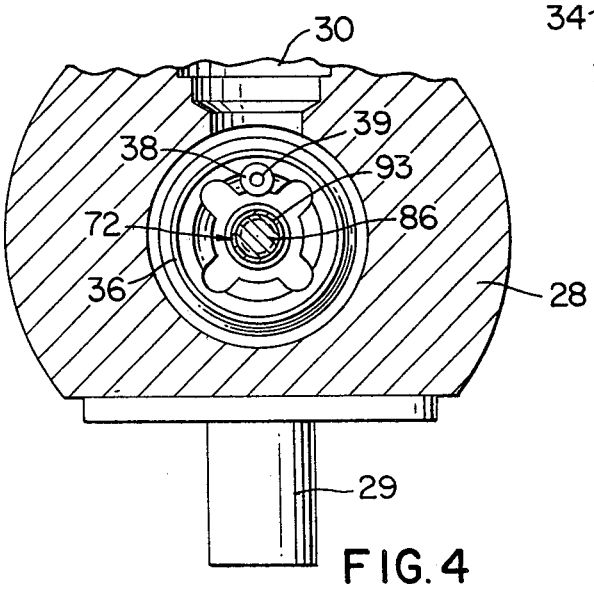
FIG. 4 is a fragmentary, cross-sectional view taken on line 4—4 of FIG. 1.

Rotation of the shaft means 72 by the knob 76 to the "off" position illustrated in FIG. 1 causes the shaft part 71 and part 87 interconnected thereto to rotate in unison and thereby rotate the shaft part 90 and cause the same to rotate relative to the threaded end 94 of the pin 95 and thereby axially move to the left relative thereto by unthreading on the end 94 whereby the abutment 91 of the part 90 moves to the left in FIG. 1 a sufficient distance that even though the power element 54 is in its completely collapsed condition, the spring 105 will maintain the valve disc 58 fully seated against the valve seat 36 so as to close not only the valve seat 36, but also close the small valve seat 38 that is disposed inboard of the main valve seat 36 in the manner illustrated in FIG. 4.

Figure 5:
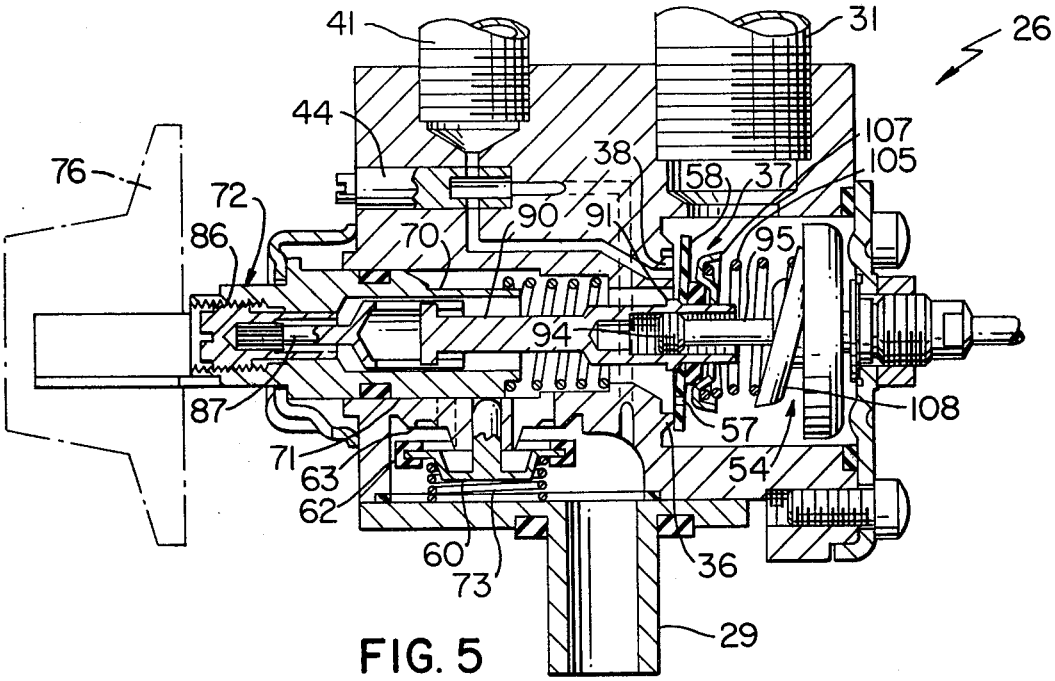
FIG. 5 is a fragmentary view similar to FIG. 1 and illustrates the control device of this invention as the same has its thermostatically operated valve means initially opening.

However, when the shaft means 72 is rotated by the knob 76 to an "on" position thereof, such rotation of the shaft part 71 not only causes the cam means 70 thereof to operate against the rounded end 69 of the poppet valve member 60 to move the same to a fully open condition thereof as illustrated in FIG. 5, but also such rotation of the shaft part 71 causes the member 90 to thread onto the member 94 and be moved to the right in FIG. 1 to abut and move the valve member 58 therewith so that the valve seat 36 will be fully opened as long as the temperature in the oven chamber 24 is not at the temperature setting of the selector means 35.

However, when the power element 54 expands as the temperature in the oven chamber 24 increases, the power element 54 will expand in such a manner that the same will move the valve disc 58 fully against the valve seat 36 when the output temperature effect in the oven chamber 24 is substantially at or slightly above the set temperature setting of the selector means 35.

From the above, it can be seen that the control device 26 can be formed in a relatively simple manner to provide a positively closed main "on-off" poppet valve member and a thermostatically controlled valve means 37 to be utilized in the fuel control system 20 in a manner now to be described.

When the operator desires to utilize the cooking apparatus 25, the knob 76 of the selector means 35 is moved from the "off" position thereof to the desired temperature setting position thereof. As the shaft means 72 is being rotated by the knob 76, the cam surface 70 of the shaft part 71 acts against the stem 67 of the poppet valve member 60 to move the same to an open position as illustrated in FIG. 5 and hold the same in such open position regardless of where the selector means 35 is subsequently set in any of its oven "on" positions.

If desired, the poppet valve member 60 and the shaft part 71 can be formed of steel to reduce wear therebetween for long life, such cam arrangement reducing or eliminating the need for lubrication in the field as is required by prior known main "on-off" valve arrangements.

Also, such opening of the poppet valve means 34 causes an initial full flow of fuel through the valve seat 63 as the valve member 60 tends to open with a snap movement once the same is initially cracked open by the cam 70 of the shaft means 72 and because the poppet valve means 34 is disposed in the inlet without having a restricted or torsions flow path for the fuel to pass through before the same reaches the thermostatically operated valve means 37.

As previously stated, such rotation of the shaft means 72 causes the member 90 to be more threaded on the threaded end 94 of the pin 95 to a certain position so that the valve disc 58 is held away from the valve seat 36 by the abutment means 91 in opposition to force of the spring 105 and thereby permits fuel to flow from the fuel source manifold 21 through the open poppet valve means 37 to the outlet 30 and, thus, to the safety valve control device 27. Fuel also flows through the opened valve seat 38 to the pilot burner means 42 to create the heater flame 46. When the heater flame 46 is created, the same is detected by the detector 47 and the poppet valve member 51 of the control device 27 is moved to its open position whereby fuel is now adapted to flow to the main burner 23 and be ignited by the pilot burner means 42. The thus operating burner means 23 begins to heat up the oven chamber 24 to the temperature selected by the selector means 35.

When the temperature in the oven chamber 24 reaches the temperature setting of the selector means 35 or is slightly above the same, the power element 54 has expanded in such a manner that the same has caused the valve disc 58 to fully seat against the valve seat 36 and thereby close off the flow of fuel not only to the outlet 30, but also to the valve seat 38 that leads to the pilot burner means 42. In this manner, the heater flame 46 ceases to exist and the control device 27 will subsequently close thereby terminating any flow of fuel to the main burner means 23. As previously stated, during the delay in time from the time the valve disc 58 is fully seated against the valve seat 36 and the valve member 51 of the control device 27 has fully seated against the valve seat 52, the opening 57 through the valve disc 58 supplies sufficient fuel to the main burner means 23 to support combustion at the main burner means 23 so that no adverse flash back situation can exist.

The valve disc 58 remains seated against the valve seat 36 until the output temperature effect in the oven cavity 24 falls below the selected temperature setting thereof whereby the power element 54 is collapsing in such a manner that the same is pulling the shaft part 90 to the right in FIGS. 1 and 5 in such a manner that the conical abutment 91 thereof engages against the valve disc 58 to pull the same to the right therewith. However, because the compression spring 105 has one side held at an angle by the angled spring retainer 108 whereby the spring 105 has its most compressed portion disposed 180° from the valve seat 36 with a tilting action as illustrated in FIG. 5 so that each time the valve disc 58 is opened relative to the valve seat 36, the same will open with the same angle of tilt so that the flow of fuel that is adapted to pass into the thus open valve seat 38 to cause the heater flame 46 will always occur when the valve disc 58 has been initially cracked open relative to the valve seat 36 at exactly the same position in its opening movement so that proper calibration of the control device 26 can be maintained.

For example, should the valve member 58 be permitted to tilt at any random angle relative to the valve seat 38 during the initial opening of the valve member 58 relative to the valve seat 36, it will require the collapsing of the power element 54 to be at a greater degree of collapse thereof, if the valve member 58 should tilt 180° from the tilt angle illustrated in FIG. 5, before the valve member 58 will permit sufficient fuel to flow into the valve seat 38 to produce the heater flame 46 when the valve member 58 is permitted to tilt 180° from the valve seat 38 in the manner illustrated in FIG. 5.

Thus, for each temperature setting of the selector means 35, a deviation in the maintained temperature in the oven 24 would take place if the valve member 58 were not caused to open with a tilt relative to the valve seat 36 at exactly the same angle each time the same is cycled by the power element 54 to an open position thereof.

Accordingly, while the spring retainer 108 is illustrated as providing the greatest compression to the spring 105 at a position 180° from the valve seat 38, it is to be understood that the spring retainer 108 could be utilized to provide for the disc 58 to tilt 90° relative to the valve seat 38 or even at the valve seat 38 if desired, the important feature being that the tilt of the valve member 58 in its opening and closing movement relative to the valve seat 36 and, thus, relative to the valve seat 38 always to be the same for that particular control device 26 so that the particular control device can be properly calibrated in a manner now to be described.

In the embodiment of the control device 26, it can be seen that by adjusting the threaded relation of the adjusting member 86 in the shaft part 71, the position of the abutment means 91 relative to the power element 54 when the bulb 56 is sensing a certain temperature can be set so that the thermostatically operated valve means 37 will operate to produce the desired output temperature effect in the oven 24 that is selected by the selector means 35 by having the valve disc 58 open when the bulb 56 is sensing a temperature just below the selected temperature of the selector means 35 of the control device 26.

Figure 6:
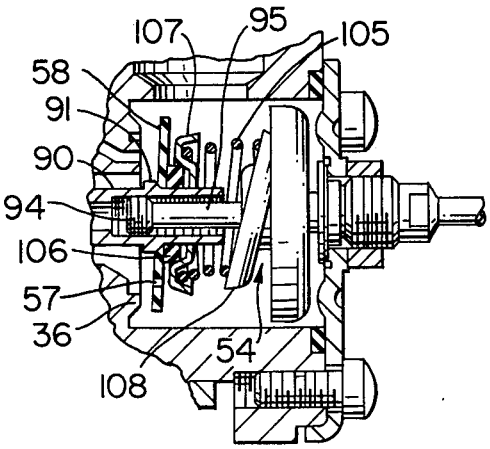
FIG. 6 is a partial view similar to FIG. 5 and illustrates the thermostatically operated valve means of the control device of this invention in a fully open position thereof.
Figure 7:
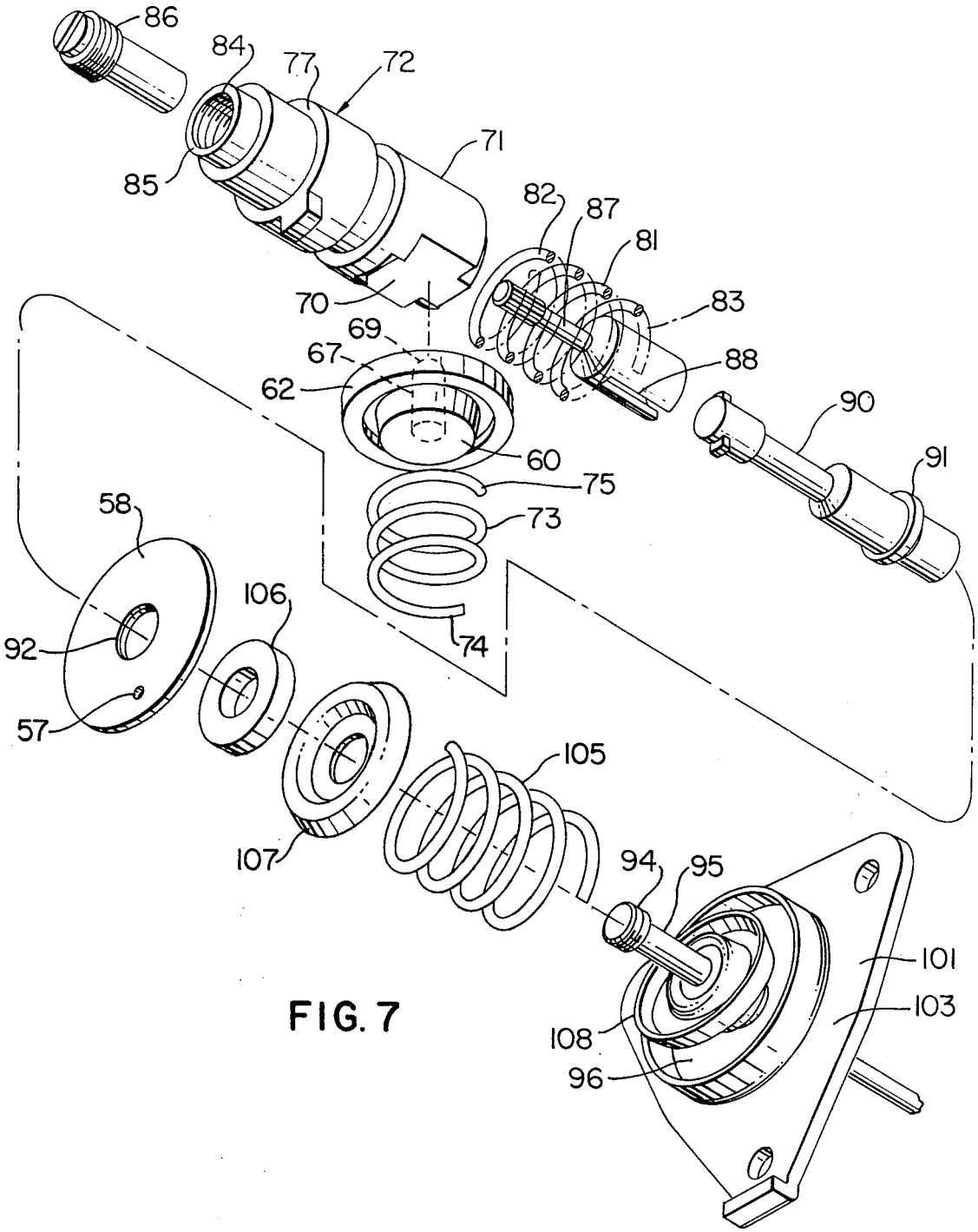
FIG. 7 is an exploded perspective view of certain parts of the fuel control device illustrated in FIG. 1.

Of course, the valve disc 58 will continue to move away from the valve seat 36 to the position illustrated in FIG. 6 should the output temperature effect in the oven 24 not increase to the setting of the knob 76 so that an increased flow of fuel will be provided to the burner means 23 through the thermostatically operated valve means 37.

Thus, the valve disc 58 can thermostatically control the flow of fuel from a minimum amount thereof that will support combustion at the burner means 23 to a full flow of fuel thereof as illustrated in FIG. 6.

The control device 26 is so constructed and arranged that when the selector means 35 is set for a broiling operation, the member 90 has been threaded on the threaded part 94 of the pin 95 such a distance that the power element 54 will not expand sufficiently to cause the valve disc 58 to fully seat against the valve seat 36 during the broiling operation so that a continuous flame broiling operation can be provided by the burner means 23.

When it is desired to turn off the control system 20, the operator rotates the control knob 76 to the "off" position of the selector means 35 whereby the flat portion of the cam surface 70 of the shaft part 71 is now adjacent the end 69 of the poppet valve member 60 so that the same can be fully seated against the valve seat 63 not only by the force of the compression spring 73, but also by the force of the fuel pressure in the inlet 29 of the control device 26. Also, such rotation of the shaft part 71 to the "off" position causes the member 90 to be unthreaded from the threaded end 94 of the pin 95 a distance sufficient that the abutment means 91 thereof will not cause the valve disc 58 to open from the valve seat 36 even though the power element 54 would be in a fully collapsed condition thereof by the bulb 56 sensing very low temperatures, such as room temperature.

Because the poppet valve means 34 has a relatively large flexible member 62 engaging the valve seat 63 when the poppet valve member 60 is moved to its closed position, any dirt particles and the like that might be on the valve seat 63 are fully enveloped by the resilient member 62 so that full closure of the seat 63 can take place and no fuel leakage through the valve seat 63 will take place because of such enveloped dirt particles.

Therefore, it can be seen that this invention not only provides an improved fuel control device 26 that has a main "on-off" poppet valve member that is positively seated by the fuel pressure when in an "off" condition thereof, but also this invention provides a fuel control system wherein two poppet valve members 60 and 51 are disposed in series relation between the source of fuel 21 and the main burner 23 and both are positively seated by fuel pressure when the same are in the "off" positions in a manner to tend to prevent any adverse high fuel pressures from escaping out of the system 20 should a malfunction occur in a pressure regulator anywhere in the fuel supply system.

While the control device 26 has been previously described as including a thermostatically operated valve means 37 therein, it is to be understood that the principles of this invention can be utilized without such thermostatically operated valve means if desired and the poppet valve arrangement thereof can be utilized as the "on-off" means for other types of control devices if desired.

For example, such poppet valve arrangement can be utilized in control devices for supplying fuel to top burners of a cooking apparatus or the like.

Figure 9:
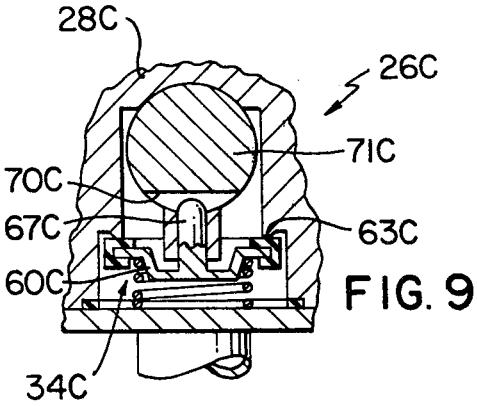
FIG. 9 is a fragmentary, cross-sectional view taken on line 9—9 of FIG. 8.
Figure 8:
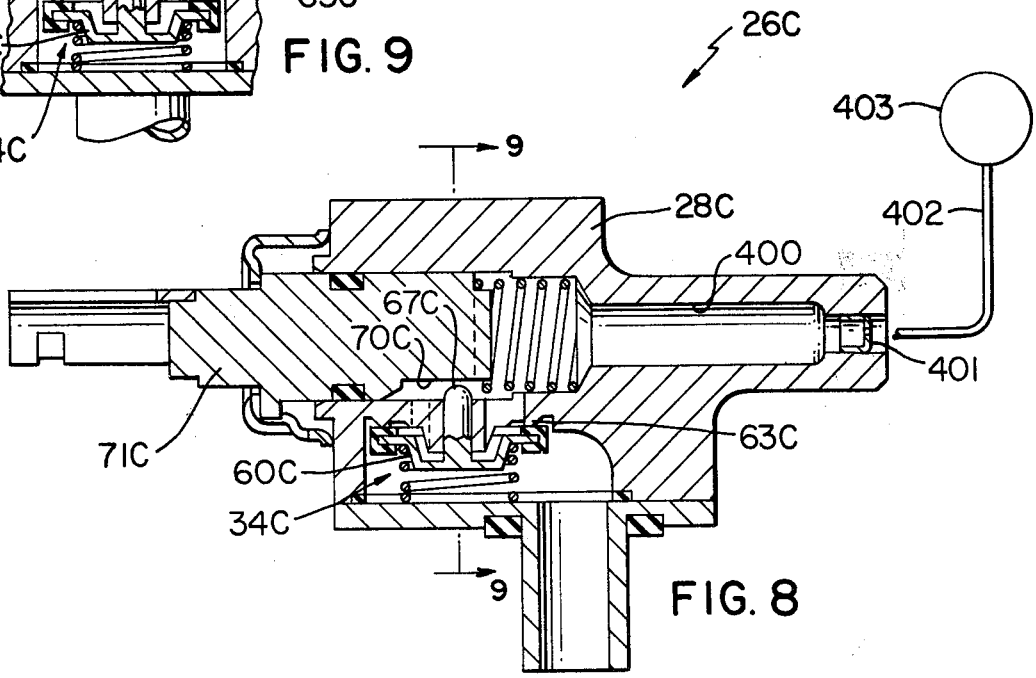
FIG. 8 is a view similar to FIG. 1 and illustrates another fuel control device of this invention.

In particular, reference is made to the FIGS. 8 and 9 wherein another control device of this invention is generally indicated by the reference numeral 26A and parts thereof similar to the control devices 26A and 26B are indicated by like reference numerals followed by the reference letter "C".

As illustrated in FIGS. 8 and 9, the control device 26C includes a housing means 28C, but does not include the thermostatically operated valve means 37 downstream from the annular valve seat 63C of the poppet valve means 34C as the valve seat 63C leads to a passage 400 in the housing means 28C which is adapted to feed through an orifice cup 401 into a conduit means 402 leading to a top burner means 403 of a cooking apparatus or the like.

Thus, the shaft 71C is merely utilized for being rotated from an "off" position thereof to an "on" position thereof wherein the cam means 70C thereof will operate against the stem 67C of the poppet valve member 60C to move the same between its opened and closed positions in the manner previously described whereby the fuel flow to the top burner 403 will either be "on" or "off" depending upon the position of the control shaft 71C.

In the fuel control device 26C previously described, no provision was made for adjusting the flame size at the main burner means after the poppet valve means had been moved to its full open position.

Figure 10:
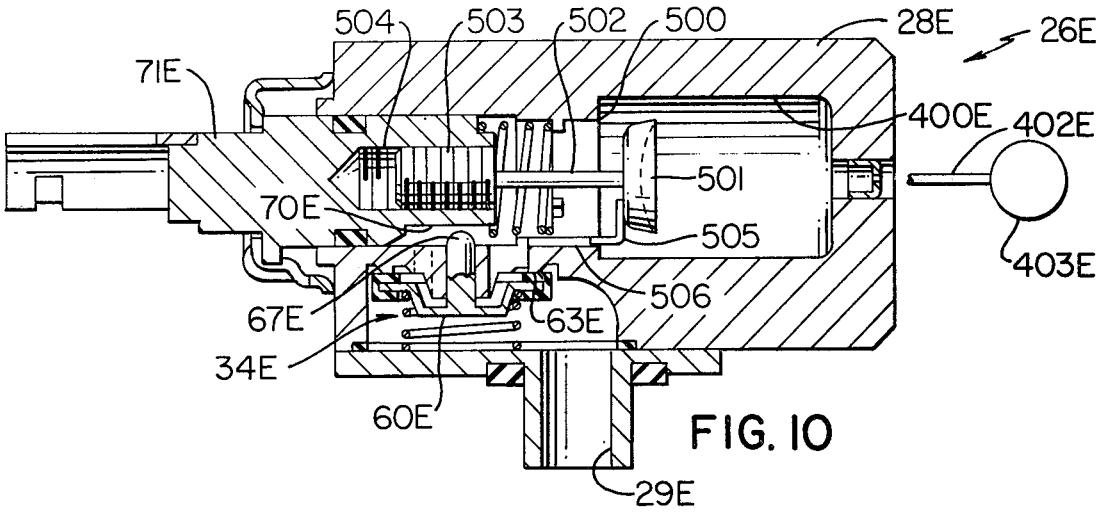
FIG. 10 is a view similar to FIG. 8 and illustrates another embodiment of this invention.
Figure 11:
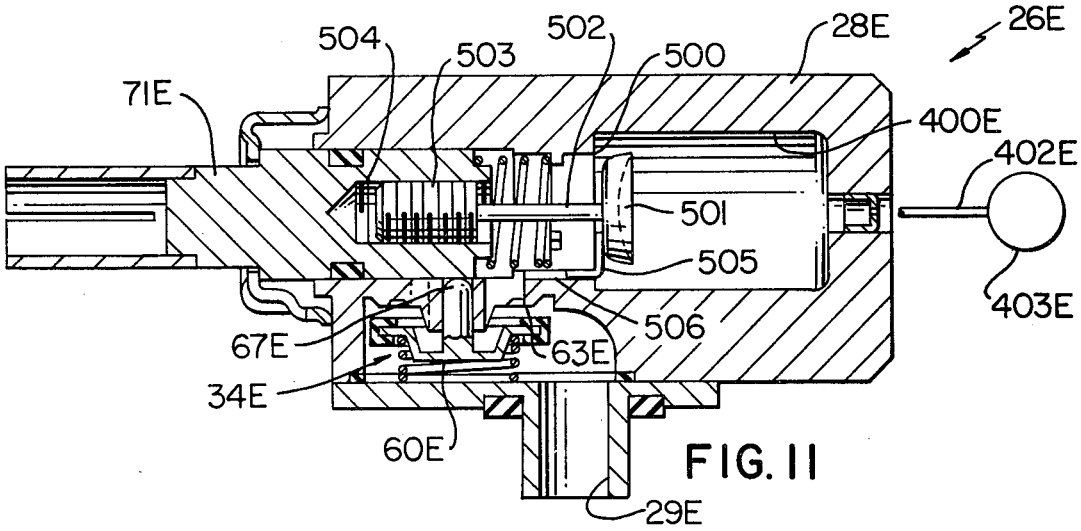
FIG. 11 is a view similar to FIG. 10 and illustrates the control device of FIG. 10 in an "on" condition thereof.
Figure 12:
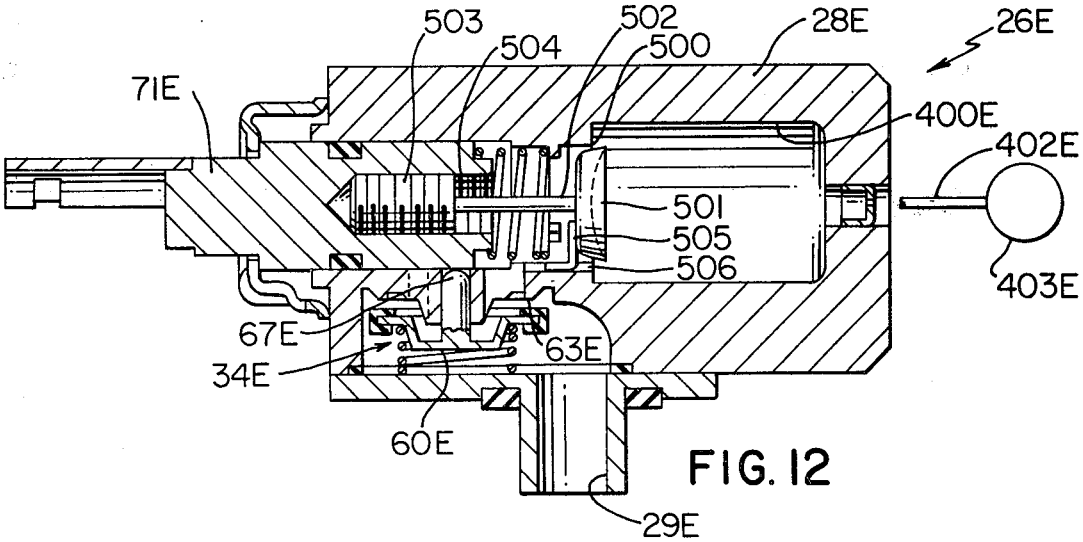
FIG. 12 is a view similar to FIG. 10 and illustrates the control device adjusted to its low fuel flow position.

Accordingly, another fuel control device of this invention is generally indicated by the reference numeral 26E in FIGS. 10–12 and parts thereof similar to the fuel control devices previously described are indicated by like reference numerals followed by the reference letter "E", the fuel control device 26E having means for controlling or throttling the fuel flow through the fuel control device downstream from the poppet valve means thereof after the poppet valve means has been moved to open position.

In particular, it can readily be seen in FIGS. 10–12 that the fuel control device 26E includes the housing means 28E, control shaft 71E, and main "on" and "off" poppet valve means 34E being operated by the cam means 70E of the shaft 71E acting on the stem 67E of the poppet valve member 60E to move the same relative to the valve seat 63E whereby fuel is adapted to flow from the inlet 29E through the open valve seat 63E, passage means 400E and conduit means 402E to the main burner means 403E.

However, the passage 400E of the housing 28E of the control device 26E has a valve seat 500 downstream from the poppet valve seat 63E that is adapted to have the flow of fuel therethrough throttled or controlled by a throttle valve member 501 being positioned relative to the valve seat 500 by the selector shaft 71E in a manner hereinafter described.

The throttle valve member 501 can have any suitable configuration to be cooperable with the valve seat 500 to throttle the fuel flow therethrough depending upon the axial position of the throttle valve member 501 relative to the valve seat 500. The throttle valve member 501 has a shaft 502 extending therefrom through the valve seat 500 and being provided with an externally threaded portion 503 which is threadedly received in a threaded bore 504 formed in the shaft 71E.

In order to prevent rotational movement of the throttle valve member 501 relative to the housing 28E during rotational movement of the shaft 71E, the throttle valve member 501 can be provided with an L-shaped tang 505 adapted to be slidingly received in a key-way slot 506 formed in the housing 28E as illustrated in FIG. 10. Thus, rotational movement of the shaft 71E relative to the housing 28E not only controls opening and closing of the poppet valve means 34E in the manner previously described, but also such rotational movement of the shaft 71E causes a changing threaded relationship between the shaft member 71E and the threaded part 503 of the throttle valve member 501 causing the same to move axially relative to the valve seat 500 for a purpose now to be described.

As illustrated in FIG. 10, the control device 26E is disposed in the "off" condition thereof wherein the poppet valve means 34E is closed so that no fuel can flow from the inlet 29E to the main burner 403E. In this position of the control device 26E, the shaft 71E when rotated to the "off" position illustrated in FIG. 10 has provided the least amount of threaded relation between the shaft 71E and the threaded valve member 501 so that the throttle valve member 501 is disposed farthest from the valve seat 500 as illustrated.

When it is desired to turn on the main burner 403E, the operator turns the shaft 71E from its "off" position to a "full on" position thereof which causes the cam means 70E to operate against the poppet valve member 60E and move the same to its fully open position as illustrated in FIG. 11. Such rotational movement of the shaft 71E from its "off" position to its "full on" position has caused the throttle valve member 501 to move axially to the left in FIG. 11 toward the valve seat 500, but such position of the throttle valve member 501 relative to the valve seat 500 still provides a sufficient distance of the valve member 501 from the seat 500 so that a full fuel flow is provided through the valve seat 500 to the burner means 403E to create the largest predetermined flame size at the burner means 403E during the operation thereof.

However, should the operator desire to reduce the flame size at the main burner 403E, the operator continues to rotate the shaft 71E in the opening direction thereof and such rotation of the shaft 71E does not further affect the poppet valve means 34E as the same still remains fully opened as illustrated in FIG. 12, but such rotational movement of the shaft 71E causes the part 503 of the throttle valve member 501 to thread further into the threaded bore 504 of the shaft 71E and thereby have the throttle valve member 501 move closer to the valve seat 500 cutting off or throttling the flow therethrough to thereby reduce the flame size at the main burner means 403E to the desired level thereof.

The throttle valve member 501 and valve seat 500 can be so constructed and arranged that when the throttle valve member 501 is fully received into the valve seat 500 by the control shaft 71E being rotated to its full limit in an opening direction thereof, a minimum flow of fuel is still provided therebetween which is sufficient to maintian combustion at the main burner 403E with the minimum size flame permissible so that it will be impossible for the operator to reduce the flame size of the burner means 403E to a position where the flame will be extinguished and raw gas would still be able to escape therefrom as the poppet valve means 34E would be remaining in its open condition.

Therefore, it can be seen that the control device 26E of this invention readily permits the operator to control a main on-off poppet valve means 34E in the manner previously described and thereafter control the size of the flame at the main burner means being supplied fuel from such fuel control device.

When it is desired to turn off the fuel control device 26E, the operator merely rotates the shaft 71E back to its "off" position whereby such rotational movement of the shaft 71E causes the throttle valve member 501 to move to the right and, thus, further away from the valve seat 500 until the same reaches the position illustrated in FIG. 10 at which time the cam means 70E of shaft 71E has permitted the poppet valve member 60E to seat against the valve seat 63E to fully close off the inlet 29E from the main burner means 403E.

Another fuel control device of this invention for adjusting the flame size at the main burner means after the poppet valve means has been initially moved to its full open position is generally indicated by the reference numeral 26J in FIGS. 13–19 and parts thereof similar to the fuel control devices previously described are indicated by like reference numerals followed by the reference letter "J".

It can be seen that the fuel control device 26J includes the housing means 28J, control or selector shaft 71J and main "on" and "off" poppet valve means 34J being operated by the cam means 70J of the shaft 71J acting on the stem 67J of the poppet valve member 60J to move the same relative to the valve seat 63J whereby fuel is adapted to flow from the inlet 29J through the open valve seat 63J, passage means 400J and conduit means 402J to the main burner means 403J.

However, the passage means 400J of the housing means 28J of the control device 26J has throttling means that is generally indicated by the reference numeral 800 downstream from the poppet valve seat 63J and that is adapted to have the flow of fuel therethrough throttled in substantially a linear manner between the highest flame size and the lowest flame thereof as the throttling means 800 is being infinitely operated by the selector shaft 71J in a manner hereinafter described.

The throttling means 800 of the control device 26J comprises a stationary member or disc 801 and a rotatable member or disc 802 adapted to be rotated relative to the member 801 by the control shaft 71J in a manner hereinafter described, the member 801 being held stationary in the passage means 400J of the housing means 28J in any suitable manner.

If desired, the stationary member 801 can have a projection 803 extending from the side 804 thereof to be received in a locating notch 806 formed in the housing means 28J to not only orient the member 801 relative thereto, but also to prevent rotational movement therebetween.

Figure 15:
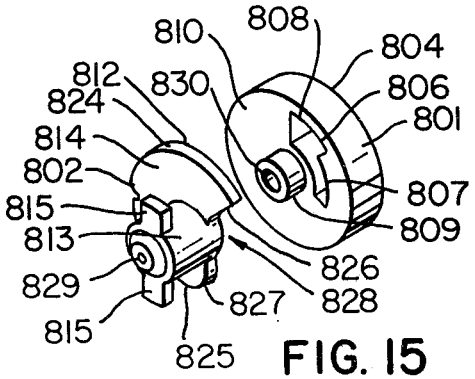
FIG. 15 is an exploded perspective view of the fuel valve control parts of the control device of FIG. 13.

As illustrated in FIG. 15, the stationary member 801 has an aperture means 806 passing therethrough with the aperture means 806 having a narrow arcuate portion 807 interconnected to a wider arcuate portion 808 for a purpose hereinafter described.

The stationary member 801 has a central hub 809 projecting from the side 810 thereof to be telescopically received within a central opening 811 formed in the side 812 of the rotatable member 802 whereby the rotatable member 802 is rotatably mounted on the hub part 809 of the stationary member 801 as illustrated.

The rotatable member 802 has a central part 813 extending from the side 814 thereof and contains the opening 811 previously described, the central part 813 of the rotatable member 802 having a pair of opposed integral tangs 815 extending therefrom and being received in cooperating slots 816 in the selector shaft 71J so that the rotatable member 802 is splined to the selector shaft 71J to rotate in unison the with while permitting axial movement therebetween.

A compression spring 817 is carried in an opening 818 of the selector shaft 71J and has one end 819 bearing against the end 820 of the selector shaft 71J while the other end 821 thereof bears against the central part 813 of the rotatable member 802 whereby the force of the compression spring 817 not only moves the rotatable member 802 axially on the hub 809 of the stationary member 801 to place the side 812 of the rotatable member 802 into sealing engagement with the face 810 of the stationary member 801, but also urges the selector shaft 71J in a direction to the left in FIG. 35 to position a locking tang 822 of the selector shaft 71J in a locking recess 823 in the housing means 28J for locking the rotatable shaft 71J in its "off" position as will be apparent hereinafter.

The members 801 and 802 can be made of a self-lubricating plastic material which could eliminate the need for oiling and thus would eliminate clogging of the throttle means 800 so that the same can insure that the gas flow therethrough would be substantially linear as will be apparent hereinafter.

The rotatable member 802 of the throttling means 800 has an outer peripheral profile 824 defined by a spiral-like edge surface 825 that terminates at a high point dropoff surface 826 spaced from the beginning low point or part 827 of the spiral surface 825 by a gap or recess 828 disposed therebetween for a purpose hereinafter described.

The movable member 802 of the throttling means 800 is so oriented relative to the aperture means 806 of the stationary member 801 that the same cooperate together to provide substantially a linear flow of fuel through the aperture means 806 as the selecting shaft 71J is being rotated so that the flame means at the main burner means 403J can be reduced in a substantially linear manner for each increment of rotation of the selector shaft 71J in one direction or be increased in a substantially linear manner for each increment of rotation of the selector shaft 71J in the opposite direction in a manner now to be described.

Figure 13:
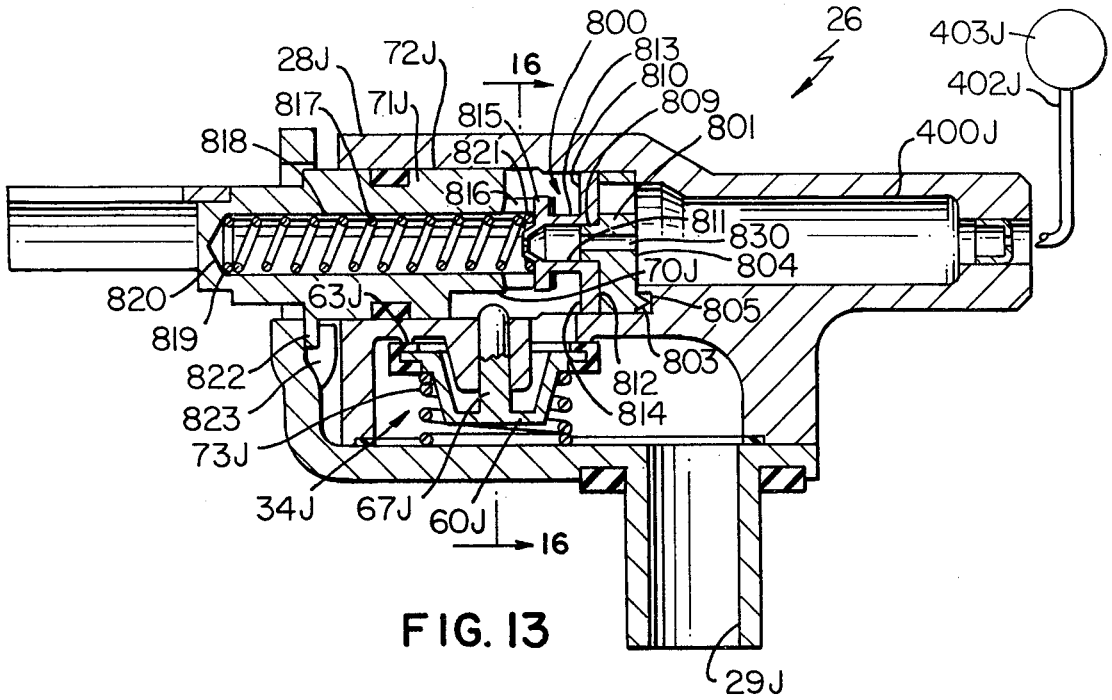
FIG. 13 is a view similar to FIG. 8 and illustrates another control device of this invention.
Figure 14:
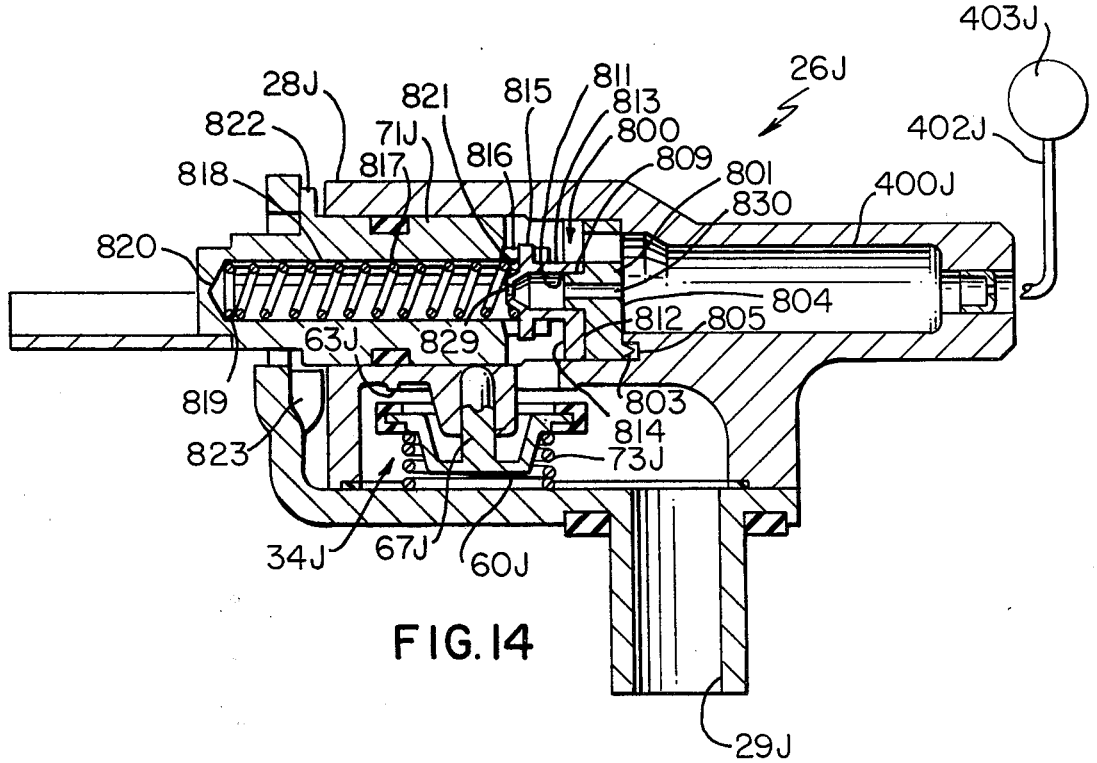
FIG. 14 is a view similar to FIG. 13 and illustrates the control device of FIG. 13 in an open condition thereof.
Figure 16:
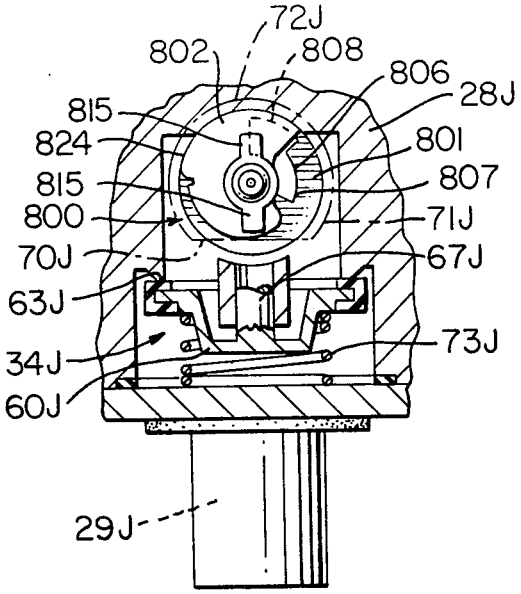
FIG. 16 is a fragmentary cross-sectional view taken on line 16—16 of FIG. 13.

When the selector shaft 71J of the control device 26J is disposed in the "off" position illustrated in FIGS. 13 and 16, it can be seen that the cam surface 70J of the selector shaft 71J causes the stem 67J of the poppet valve member 60J to permit the poppet valve member 60J to be fully seated against the valve seat 63J by the force of the compression spring 73J whereby no fuel can flow from the inlet 29J to the passage means 400J of the control device 27J, let alone to the main burner means 403J, even though the profile 824 of the rotatable member 802 of the throttling means 800 is disposed in a position partially opening the full aperture means 806 of the stationary member 802 in the manner illustrated in FIG. 16.

Figure 17:
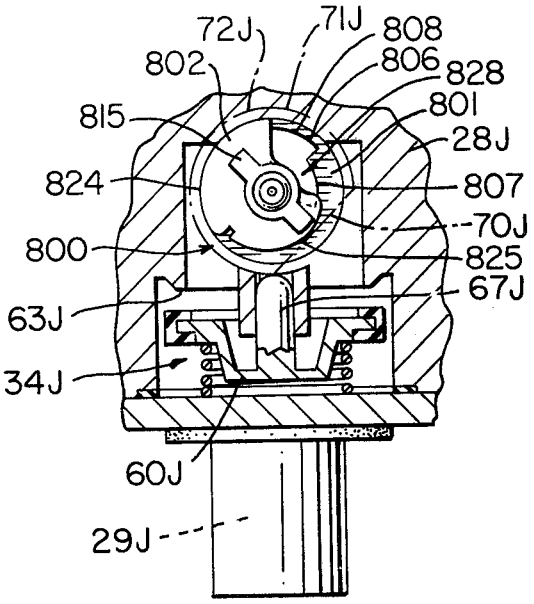
FIG. 17 is a view similar to FIG. 16 and illustrates the control device in "on" condition thereof.
Figure 18:
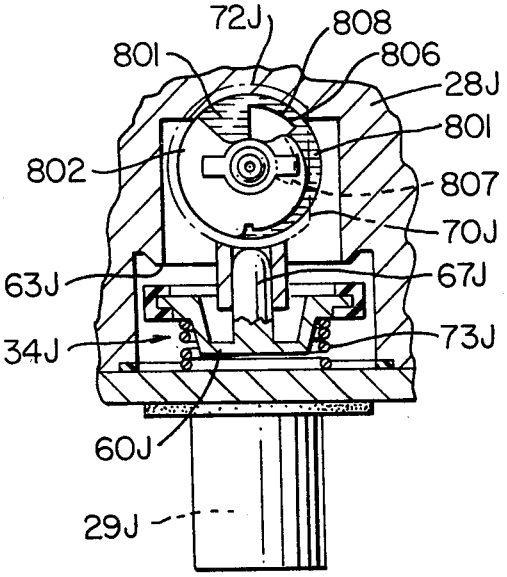
FIG. 18 is a view similar to FIG. 17 and illustrates the control device in an adjusted "on" position thereof.

When the operator desires to turn on the burner means 403J, the operator rotates the shaft 71J in a counterclockwise direction from the "off" position of FIG. 16 to the "on" position of FIG. 17 whereby it can be seen that the cam means 70J has now acted against the stem 67J of the poppet valve member 60J to move the poppet valve member 60J to an open position relative to the valve seat 63J to fully interconnect the inlet 29J to the passage 400J of the control device 26J. In this initial full "on" position of the poppet valve member 60J, it can be seen that the rotatable member 802 of the throttling valve means 800 is now so positioned relative to the aperture 806 of the stationary member 801 that the recess 828 and the profile 824 fully opens the aperture 806 so that the entire flow of fuel is permitted through the throttling valve means 800 to the main burner means 403J to produce the largest flame size at the main burner means 403J.

Figure 19:
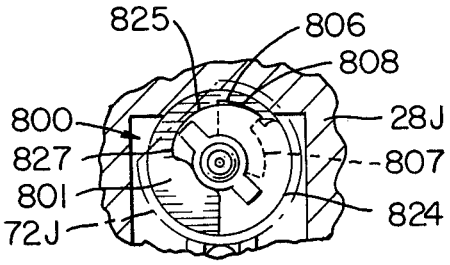
FIG. 19 is a view similar to FIG. 18 and illustrates the control device in another adjusted "on" position thereof.

However, should the operator desire to reduce the flame means at the main burner means 403J, the selector shaft 71J is further rotated in a counterclockwise direction from the full "on" position illustrated in FIG. 17 to any desired rotational position thereof whereby it can be seen that the spiral cam profile 825 of the rotatable member 802 will progressively close off the aperture 806 from the full "on" position illustrated in FIG. 17 to almost a fully closed position as illustrated in FIG. 19 and such movement of the profile 824 of the rotatable member 802 relative to the stationary member 801 causes a substantially linear decrease in the size of the flame means at the main burner means 403J from the highest flame means thereof to the lowest flame means thereof as permitted by the limits of rotation of the selector shaft 71J in the counterclockwise direction as illustrated in FIG. 41.

Thus, it can be seen that the throttling valve means 800 of this invention permits the operator of the burner means 403J to effectively set the desired height thereof in a smooth infinite manner without large variations in the flame setting adjustments thereof.

Obviously, if the operator reduces the flame size too much and desires to thereafter increase the flame size, the selector shaft 71J is merely turned in a clockwise direction until the flame size has increased to the desired size.

When it is desired to turn off the burner means 403J, the selector shaft 71J is rotated in a clockwise direction until the locking tang 822 thereof is received in the notch 823 at which time the cam profile 72J of the selector shaft 71J has permitted the poppet valve 60J to fully seat against the valve seat 63J as well as position the rotatable member 802 to the "off" position illustrated in FIG. 16 whereby the flow of fuel to the main burner means 403J is completely terminated.

In order to unlock the locking tang 822 of the selector shaft 71J from the locking notch 823 of the housing means 28J, the selector shaft 71J can be slightly moved axially inwardly into the housing means 28J to clear the tang 822 out of the locking recess 823 as the compression spring 817 permits such axial movement while still maintaining the rotatable member 802 in sealing engagement with the stationary member 801 to permit the flame adjustment means previously described.

If the selector shaft 71J is in its "off" position as illustrated in FIGS. 13 and 16, so that the poppet valve member 60J is closing off the valve seat 63J, it may be desired to provide a continuous flow of fuel to the burner means 403J for pilot burner purposes and therefore the rotatable member 802 and stationary member 801 of the throttling valve means 800 are respectively provided with openings 829 and 830 through the central parts thereof so that should the rotatable member 802 ever be in such a position relative to the stationary member 801 to completely close off the aperture means 806 thereof, at least the openings 829 and 830 will continuously supply the pilot burner of the burner means 403J with a minimum flow of fuel to support complete combustion thereof so that adverse flame flash back problems cannot be provided for the burner means 403J.

While the forms of the invention now preferred have been described and illustrated as required by the Patent Statute, it is to be understood that other forms may be utilized and still come within the scope of the appended claims.

What is claimed is:

1. A fuel control device having passage defining means for interconnecting a fuel source with a main burner means, said control device having a rotatable selector shaft means, said control having throttle valve means for throttling fuel flow through said passage defining means to said burner means, said selector means being operatively interconnected to said throttle valve means to operate the same, said throttle valve means having adjustment means for providing substantially linear fuel flow adjustment, said adjustment means comprising a pair of members carried by said control device, one of said members being stationary and having aperture means therethrough, the other of said members being movable by said selector means relative to said one member to control the effective opening of said aperture means for fuel flow therethrough, said other member being rotatable relative to said one member, said other member being rotatably mounted on said one member, said one member having a central hub part extending from one side thereof, said other member having a central hub part thereof telescopically receiving said hub part of said one member to rotatably mount said other member thereon, said hub part of said other member having spline means thereon, said selector shaft means having spline means interconnected to said spline means of said hub part of said other member whereby said spline means cause said other member to rotate in unison with the rotation of said selector shaft means while permitting axial movement therebetween.

2. A fuel control device as set forth in claim 1 wherein said central hub parts of said members have interconnected opening means therethrough for providing minimum fuel flow therethrough.

3. A fuel control device as set forth in claim 1 wherein a spring means is carried by said control device and bears against said other member to hold the same on said hub part of said one member and provide a sealing relationship between said members.

4. A fuel control device as set forth in claim 3 wherein said spring means also bears against said selector means to urge said selector means in one direction relative to said control device for selector means latching purposes.

* * * * *